US005131358A

United States Patent [19]

Grieshaber et al.

[11] Patent Number: 5,131,358

[45] Date of Patent: Jul. 21, 1992

[54] DEVICE FOR STOPPING AN INTERNAL COMBUSTION ENGINE

[75] Inventors: Hermann Grieshaber, Aichtal-Aich; Wilhelm Polach, Möglingen, both of Fed. Rep. of Germany

[73] Assignee: Fuji Photo Film Co. Ltd., Kanagawa, Japan

[21] Appl. No.: 656,083

[22] PCT Filed: Mar. 9, 1990

[86] PCT No.: PCT/DE90/00173

§ 371 Date: Feb. 27, 1991

§ 102(e) Date: Feb. 27, 1991

[87] PCT Pub. No.: WO91/01445

PCT Pub. Date: Feb. 7, 1991

[30] Foreign Application Priority Data

Jul. 20, 1989 [DE] Fed. Rep. of Germany ..... 3924128

[51] Int. Cl.[5] ..... F02B 77/08

[52] U.S. Cl. ..... 123/198 DB; 123/DIG. 11

[58] Field of Search ..... 123/198 DB, DIG. 11

[56] References Cited

U.S. PATENT DOCUMENTS 4,106,470 8/1978 Saizar ..... 123/198 DB
4,108,129 8/1978 Rognon ..... 123/198 DB
4,124,013 11/1978 Rivalto ..... 123/198 DB
4,318,379 3/1982 Knorreck ..... 123/198 DB

FOREIGN PATENT DOCUMENTS 1576658 3/1977 Fed. Rep. of Germany .

*Primary Examiner*—Noah P. Kamen

[57] ABSTRACT

The control device enables an electrically triggered steering wheel key top and, in electronically controlled fuel injection pumps, provides a redundantly acting safety stopping device. For this purpose a 2/2-way valve is used as magnet valve (19), its switching state being determined by the position of the steering wheel key on the one hand and by a switching contact (16) of a diesel engine control device (17) on the other hand. The magnet valve (19) control the flow of engine lubricating oil to an operating piston (28) which can displace a control rod of the fuel injection pump, which controls the quantity of fuel delivered to the internal combustion engine, into its working area. The deflection of the operating piston (28) is influenced by a throttle (42) and a check valve (33), so that the control rod (44), after a stop position "O", automatically arrives in a start position "S" required for restarting the internal combustion engine. This control device is suitable particularly in fuel injection pumps for diesel internal combustion engines.

5 Claims, 1 Drawing Sheet

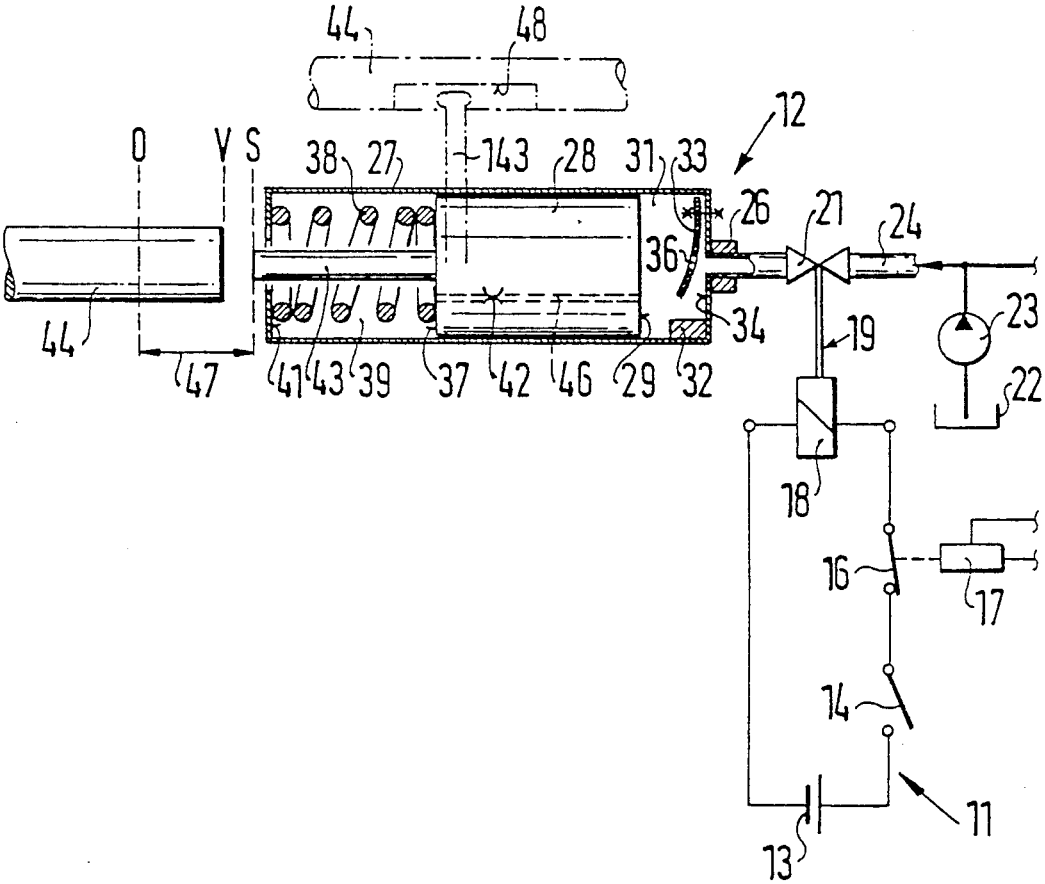
44
48
12
O
V
S
38
27
143
28
31
33
26
21
24
36
34
23
19
22
44
47
41
43
39
37
42
46
29
32
18
16
17
14
11
13

DEVICE FOR STOPPING AN INTERNAL COMBUSTION ENGINE

BACKGROUND OF THE INVENTION

The present invention relates to a control device for stopping an internal combustion engine and, more particularly, to a control device for the elimination of periodic oscillations between operating states of an internal combustion engine, which is being stopped.

Control devices for series injection pumps in which the control rod is brought into a stop position via an operating piston controlled with an auxiliary energy in mechanically regulated series injection pumps with key-activated stopping are already known. A hydraulic control device using the fuel pressure has been suggested. Also a pneumatic control device using excess air pressure or vacuum has been proposed to solve this problem. In addition, an electrical control device for this purpose has been suggested using electrical energy as the auxiliary energy. None of these control devices for stopping the internal combustion engine would be reliable.

If the fuel pressure is used to provide the auxiliary energy, a diesel fuel brine and filter clogging can occur at low temperatures. As in the case of fuel leakages, the pressure build-up in this case is also disturbed or even no longer producible.

The same is true for compressed air as auxiliary energy when the auxiliary energy is no longer available in sufficient quantity due to compressed air leakages, e.g. because of a pressure drop in the compressed air container over longer standing times.

A complete failure of the auxiliary energy can occur, often without warning, when power is supplied by current when a current failure occurs in the electrical lines for various reasons.

According to DE-AS 15 76 658, it is known in a control device of this type to utilize engine lubricating oil pressure as auxiliary energy for the shut-off or stopping device. In so doing, a front side of the control rod is acted upon directly by the engine lubricating oil, which is under pressure, for stopping the series injection pump and a displacement of the control rod is accordingly triggered in such a way that the latter arrives in its stopping position and the fuel feed is switched off. A magnet valve in the form of a 3/2-way valve, which is connected to the generator, is used to control this process, a relief line being connected to the magnet valve in addition to a feed and discharge pressure line.

However, a disadvantage in this arrangement consists in that the pressurized space, which is acted upon by the lubricating oil for moving the control rod into the stopping position, can be relieved for restarting only via the 3/2-valve which is costly in terms of construction. Since the 3/2-valve enables the control rod to move out into the stopping position only as a result of its operation, a current failure, which can occur e.g. because of a broken cable, can make it possible to stop at all.

Moreover, in this arrangement when the engine is stopped the holding current for the electromagnet of the magnet valve has already dropped so far at very low engine speed of the internal combustion engine, during which the generator no longer gives off sufficient voltage for operating the magnet valve, that the magnet valve closes again and the regulating path is at least partially reopened, the engine catches, restarts and does not completely stop again. This state correspond to a regulating behavior known as "hunting" and is a periodic oscillation between two unwanted operating states, so that a sure stopping of the internal combustion engine is prevented.

SUMMARY OF THE INVENTION

It is an object of the present invention to provide a stopping device for a motor vehicle, which has none of the above disadvantages.

These objects and others which will be made more apparent hereinafter are attained in a control device for stopping an internal combustion engine, particularly a diesel internal combustion engine, comprising a stopping element, which acts on a delivery quantity adjusting element of a fuel injection pump of the internal combustion engine, and also an electrical control circuit including a key-operate main switch and an electromagnetic operated valve. The stopping element is controlled by the valve, which connects a source of engine lubricating oil pressure to the stopping element for activation of the stopping element. The key-operated main switch and the electromagnetic operated valve are connected in such a way that, when stopping the internal combustion engine, the delivery quantity adjusting element of the fuel injection pump is moved into a stopping position, "0", by the engine lubricating oil acting in a pressurizable space of the stopping element and, after the stopping has occurred, the delivery quantity adjusting element is moved by a return spring into a start position, "S", enabling restarting of the internal combustion engine.

According to the present invention, the valve is a 2/2-way valve, which is open when current does not flow through the electromagnet, and the stopping element comprises an operating cylinder and an operating piston, which bounds the pressurizable space in the operating cylinder and is guided in the operating cylinder, and a flow-off throttle, which connects the pressurizable space with another space having low pressure for enabling a restarting, and a check valve, which is connected between the valve and the pressurizable space and opens into the pressurizable space when acted on by engine oil.

In contrast to the above, the control device, according to the invention, prevents the aforementioned disadvantages. For this purpose, it comprises a simple 2/2-way valve, as valve, which utilizes the pressure of the engine lubricating oil as auxiliary pressure and is open in the currentless state, so that the pressure feed remains connected to the pressurizable space of the operating piston and, when the fuel injection pump comes to a stop, the relieving of the engine lubricating oil, which moves the control rod into the stopping position in the event of stopping, is effected without being controlled and in an automatic manner by communicating with the flow-off throttle the pressure-space of the operating piston. Accordingly, the control rod automatically reaches the position required for releasing the start after the stopping of the fuel injection pump.

The unwanted periodic incomplete stopping, described in disadvantageous terms with respect to the prior art as "hunting", is reliably prevented in the arrangement according to the invention by the check valve, which is connected upstream of the pressure space from the pressure source and prevents an excessively rapid flowing off of the engine lubricating oil from the pressure space, and accordingly a restarting of the internal combustion engine, in the event of stopping, when the lubricating oil pressure drops too quickly.

Due to this step, the control rod remains in the stopped position until the internal combustion engine is securely stopped, regardless of how fast or at what time the oil pressure in the internal combustion engine drops.

A flow-off duct is preferably incorporated directly in the operating piston to produce the pressure balance between the pressure space and the spring space (low pressure space), so that the control rod automatically goes from the stop position to the start position.

The check valve, which is constructed as a flap valve, makes it possible to achieve an effective switching behavior in a particularly sensitive manner, when there are only low actuating forces, and to prevent hysteresis processes in the regulating behavior of the control device.

The regulating behavior of the control device can be additionally influenced by the flow retarding element incorporated via the return-flow throttle.

BRIEF DESCRIPTION OF THE DRAWING

The objects, features and advantages of the present invention will now be illustrated in more detail by the following detailed description, reference being made to the accompanying drawing in which:

The sole figure shows one example of a control device for stopping an internal combustion engine according to the invention.

DETAILED DESCRIPTION OF THE INVENTION

The control device for stopping a diesel internal combustion engine according to the single, simplified drawing comprises an electrical control circuit 11 and a hydraulic control circuit 12 cooperating with the latter. This control device forms a starting and stopping device.

A battery 13, an operating contact 14 of a main switch which is designated in general as a steering wheel lock, a switching contact 16, which is connected in series with the operating contact 14 and constructed as a break contact and actuated by a diesel motor control device 17 of an electronic regulating device, not completely shown, as well as an electromagnetic operated valve 19 constructed as a 2/2-way valve are connected in series in the electrical control circuit 11.

A valve structural component 21 of the valve 19 is opened in the currentless state of the electromagnet 18 and is part of the hydraulic control circuit 12 which has a crankcase 22 receiving the engine lubricating oil, from which an oil pump 23, which is operated simultaneously with the internal combustion engine, delivers the engine lubricating oil to the lubricating points of the internal combustion engine and into a pressure line 24, in which the valve structural component 21 is located and which leads to an operating cylinder 27 via pressure connection piece 26.

An operating piston 28 is supported in the operating cylinder 27 so as to be displaceable in a tight manner; the end face 29 of the operating piston 28 on the pressure or delivery side facing the pressure connection piece 26 defines a pressurizable space 31, which contains a stop 32 and a check valve 33. The stop 32 limits the movement of the operating piston in a direction corresponding to a reduction in volume of the pressurizable space 31. The stop 32 is adjustable as a function of operating characteristic values, e.g. as a function of the temperature of the engine lubricating oil.

The check valve 33 is fastened at a base 34 of the operating cylinder 27. The base 34 closes the pressurizable space 31 and is arranged at the front side. The check valve 33 curves away from the base 34 with its free end, depending on the type of construction, as a result of a inherent spring tension or flow pressure. As a result of its small inherent tension due to flow forces of engine lubricating oil exiting from the pressurizable space 31 toward the pressure line 24, the check valve 33 can easily be forced on the base 34 or already contacts the base 34 because of inherent tension.

The pressure connection piece 26 has a throughput cross-section corresponding to a small residual cross-section, which is formed by a return-flow throttle 36 located in the check valve 33. The operating piston 28 is loaded at an end face 37 on the side of the piston 28 remote of the pressurizable space 31 by a pretensioned return spring 28 which is supported at an inner wall 41 of the operating cylinder 27. The inner wall 41 closes a spring space 39 and is arranged at the front side. The spring face 39 acts as the low pressure space referred to hereinbelow in the example presented here.

The end face 29 of the operating piston 28 on the delivery side and the end face 37 of the operating piston 28 on the spring space side are connected by a flow-off duct 46 with a flow-off throttle 42. The flow-off duct 46 is constructed as a longitudinal bore hole in the operating piston 28, the flow-off throttle 42 being located therein.

A peg-shaped transmission element 43, which penetrates the inner wall 41 of the operating cylinder 27 and can be made to engage with the control rod 44 serving as a delivery quantity adjusting element, projects out of the end face 37 of the operating piston 28 on the side of the spring space. The transmission element 43 is coaxial to the operating piston 28.

As an alternative to this engagement of the control rod 44 on the front side, engagement of the control rod 44 with the piston 28 can occur via a transmission element 143, shown in dash-dot lines, which projects out of the operating piston 28 at a right angle and, in this case, engages in a longitudinal groove 48 of the control rod 44 or in a suitable structural component part of the regulator and moves the latter into the "0" stop position, but does not impede its regulating movement in normal operation.

The arrangement described above functions and acts in the following manner: Proceeding from a diesel internal combustion engine in operation, the operating contact 14 of the main switch is put into its open position when the engine is stopped, wherein the electromagnet 18 valve 19 is without current and the valving element 21 reaches its rest position in which the pressure line 24 is opened.

The oil pump 23, which is couple with the internal combustion engine, is capable of sucking engine lubricating oil out of the crankcase 22 due to the fact that the internal combustion engine is still running and of delivering the oil to the pressure line 24. The check valve 33, which is closed when the valve 19 is closed, is now acted upon by the pressure of the engine lubricating oil and opens the passage at the base 34, so that the engine lubricating oil, which could obviously only flow through the return-flow throttle 36, now reaches the pressurizable space 31 in the main flow, so that the operating piston 28 is quickly displaced against the force of the return spring 38, and the transmission element 43 connected with the latter shifts the control rod 44 to the left, e.g. from its starting position "S" or, as shown from its full-load position "V", into its stop position "0" which stops the delivery of fuel and in which the regulating displacement 47 of the control rod 44 is eliminated, i.e. becomes zero.

The delivery of fuel to the internal combustion engine is accordingly interrupted and the motor vehicle operated by it can stop.

The engine lubricating oil flowing from the pressurizable space 31 to the spring space 39 via the throttle 42 during this stopping process arrives back in the crankcase 22 from the spring space 39 of the operating cylinder 27, e.g. along the surface of the transmission element 43 in a so-called common oil household of the fuel injection pump and the internal combustion engine from the pump housing.

When the internal combustion engine comes to a stop, the oil pump 23, which has likewise come to a stop, can deliver no more engine lubricating oil to the operating piston 28 and the engine lubricating oil located in the pressurizable space 31 is forced toward the crankcase 22 through the flow-off throttle 42 to the spring space 39 on the one hand and through the return-flow throttle 36, the valve structural component 21, which is opened in the currentless state of the valve 19, the through-line 13, and the oil pump 23, in as much as the check valve 33 is provided with the return-flow throttle 36, as a result of the shifting of the operating piston 28 to the right by the return spring 38.

The shifting of the operating piston 28 and its transmission element 43 to the right, which continues until the end face 29 of the operating piston 28 on the pressure chamber side abuts on the stop 32, releases the complete regulating path 47 for the control rod 44, and the control rod 44 can arrive in the starting position "S" for maximum fuel injection quantity via a shifting to the right which is complete along with it.

Accordingly, the control 44, which is temporarily brought into the stop position for stopping the internal combustion engine, again arrives by itself in an operating position which enables the starting of the internal combustion engine.

When the operating piston 38 is shifted to the right during the stopping process, the check valve 33 contacts the base 34 due to the flow forces of the engine lubricating oil flowing off toward the crankcase 22, so that the flowing off of the engine lubricating oil slows down, since the small cross-sectional surface of the return-flow throttle 36 slows the emptying of the pressure space 31 toward the crankcase 22.

The accidental restarting of the engine when the oil pressure is at a low level at the time the engine is to be shot off is prevented.

The function of the check valve 33 with the return-flow throttle 36 can also be performed by a check valve 33 without return-flow throttle 36, since the flow-off throttle 42 alone already enables the return flow of the engine lubricating oil when the operating piston 28 is shifted to the right with the check valve 33. This provides the control rod 44 with the necessary regulating displacement 47 for readiness to start for a possible restarting.

It will be understood that each of the elements described above, or two or more together, may also find a useful application in other types of constructions differing from the types described above.

While the invention has been illustrated and described as embodied in a control device for elimination of periodic operational oscillations during the stopping of an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. Control device for stopping an internal combustion engine without periodic operational oscillations, said internal combustion engine having a fuel injection pump with a delivery quantity adjusting element, which adjusts a quantity of fuel delivered to the internal combustion engine, the delivery quantity adjusting element of the fuel injection pump being movable into a stopping position (O) by which delivery of fuel to the internal combustion engine from the fuel injection pump is stopped, and, after stopping the internal combustion engine, the delivery quantity adjusting element being movable into a start position (S), by which restarting of the internal combustion engine is enabled, said control device comprising:

a 2/2-way valve (19) including an electromagnet (18), said 2/2-way valve structured to be open for fluid flow when said electromagnet is not energized;

electrical control circuit means (11) including a main switch operable by a key and the electromagnet (18) and a current source, wherein said electromagnet, said main switch and said current source are connected electrically in said circuit means, so that said electromagnet is energized when said main switch is opened by said key;

means for supplying engine lubricating oil during operation of the internal combustion engine; and a stopping element comprising an operating cylinder (27) and an operating piston (28) guided slidable in said operating cylinder, said operating piston bounding a pressurizable space (31) on one side thereof in said operating cylinder, and a low pressure space being connected with said pressurizable space, said means for supplying engine lubricating oil being connected via said 2/2-way valve with said pressurizable space so as to supply oil to said pressurizable space when said valve is open, a flow-off throttle (42) through which said pressurizable space (31) is connected with said low pressure space for enablement of restarting of said internal combustion engine, a return spring (38) mounted so as to act on the fuel delivery adjusting element, a check valve (33) positioned between said valve (19) and said pressurizable space and structured to open toward said pressurizable space, so that, when stopping the internal combustion engine, the delivery quantity adjusting element of the fuel injection pump is moved into the stopping position "0" by said means for supplying engine lubricating oil providing engine lubricating oil to said pressurizable space of said stopping element through said check valve, and, after the stopping of said internal combustion engine is achieved, said delivery quantity adjusting element is moved by the return spring (38) into the start position (S) enabling restarting of the internal combustion engine.

2. Control device according to claim 1, wherein said valve is connected in series with said main switch

3. Control device according to claim 1, wherein said low pressure space is located in said operating cylinder (27) on another side of said operating piston (28) opposite from said pressurizable space (31) and said operating piston (28) has a flow-off duct (46) connecting said pressurizable space (31) and said low pressure space (39), said flow-off throttle being located in said flow-off duct, and said return spring is located in said low pressure space and positioned to act on said operating piston, said delivery quantity adjusting element being connectable to said operating piston (28) by a transmission element (43,143) so as to by movable by said operating piston.

4. Control device according to claim 1, wherein said check valve (33) is a flap valve, said flap valve acting to reduce a flow rate of said engine oil from said pressurizable space, when said engine oil flows from said pressurizable space.

5. Control device according to claim 1, wherein the check valve (33) is provided with a return-flow throttle (36), said return-flow throttle (36) acting to relieve said pressurizable space (31) when said valve (19) is opened.

* * * * *